United States Patent [19]

Fisher et al.

[11] 4,182,932

[45] Jan. 8, 1980

[54] A-M STEREO SYSTEM

[76] Inventors: Charles B. Fisher, 2850 Hill Park Rd., Montreal, Quebec H3H 1T1, Canada; Sidney T. Fisher, 53 Morrison Ave., Montreal, Quebec H3P 3C6, Canada

[21] Appl. No.: 955,154

[22] Filed: Oct. 26, 1978

[51] Int. Cl.[2] ..... H04H 5/00

[52] U.S. Cl. ..... 179/1 GS; 329/50; 329/167

[58] Field of Search ..... 179/1 GS; 329/50, 167; 325/36

[56] References Cited

U.S. PATENT DOCUMENTS

| | | | |
|---|---|---|---|
| 3,043,914 | 7/1962 | Collins | 179/1 GS |
| 3,089,095 | 5/1963 | Webb | 179/1 GS |
| 3,102,167 | 8/1963 | Barton | 179/1 GS |
| 3,109,896 | 11/1963 | Boothroyd | 179/1 GS |
| 3,217,105 | 11/1965 | Barton | 179/1 GS |
| 3,231,672 | 1/1966 | Collins, Jr. et al. | 179/1 GS |

OTHER PUBLICATIONS

"Zero-Crossing Detector . . . " by Prigozy in *Electronics,* Apr. 19, 1965, p. 91.

"Delayed Output Pulse Generator", *EEE,* 13:10, p. 71.

*Transmission Systems for Communication,* Bell Labs., Princeton, 1971, pp. 116, 117, 118 & 125 to 128.

*Reference Data for Radio Engineers,* New York, 1970, p. 21-14.

*IEEE Spectrum,* Jun. 1978, pp. 24-31, "AM Stereo".

FCC Release BC/FCC 78-638/95752, Docket No. 21313, Oct. 19, 1978, pp. 1-3.

*Primary Examiner*—Douglas W. Olms

[57] ABSTRACT

Means and method for generation and combination at a transmitting apparatus and separation and demodulation at a receiving apparatus of two signals comprising carrier waves of the same frequency but having different phase, modulated with different programs. Receiving apparatus according to this invention eliminates one of the signals in each of its two channels by sampling the combined wave at instants of zero crossings of the carrier of that signal, at a rate at least twice the highest program frequency, and then integrating the sequence of samples so produced to give the program of the other signal. Thus this system provides relatively simply compatible a-m stereo transmission, or a-m transmission of two unrelated programs on a single carrier.

6 Claims, 6 Drawing Figures

A-M STEREO SYSTEM

BACKGROUND OF THE INVENTION

This invention provides means and method for generation and reception of two programs which amplitude modulate carriers of the same frequency with a phase difference between the carriers. This technique has not been shown in any prior patent art, publication or apparatus known to us. Several of the functional elements of our invention have been described or mentioned in the prior patent art and in publications, as herein mentioned. We hereby declare that no other pertinent prior art is known to us.

BRIEF SUMMARY OF THE INVENTION

This invention provides means and method for generation and combination at a transmitting apparatus and reception, separation and demodulation at a receiving apparatus of two signals each comprising a carrier amplitude-modulated by a program, the carriers having the same frequency, but with a phase difference, and the programs either being the same, or being the two channels of a stereo program, or being wholly different.

Transmitting apparatus for this system comprises a carrier generator with a first carrier output amplitude-modulated by a first program to produce a first signal, and with a second carrier output shifted in phase and amplitude-modulated by a second program to produce a second signal. The first and second signals together produce a combined wave comprising a carrier with the same frequency as the generated carrier, with a phase intermediate between the phases of the first and second carriers, and two pairs of upper and lower sidebands corresponding respectively to the two programs.

When the phase difference between the carriers is less than 90° and the two programs are identical or are the two channels of a stereo program, the combined wave may be received and demodulated by a mono a-m receiver, with relatively small distortion of the program.

Receiving apparatus according to the invention receives the combined wave and selects from it the combined carrier freed from modulation and noise by filter circuits and limiting. The combined carrier may be then reduced in frequency in a frequency reducer to a sine wave frequency at least as great as the highest program frequency, with zero crossings at instants of zero crossings of the combined carrier, and passes through a carrier separator, which may be a simple network with two outputs, the first output delivering to a first channel a carrier with zero crossings at instants of zero crossings of the second carrier in the combined carrier of the received combined wave, the second output delivering to a second channel a carrier with zero crossings at instants of zero crossings of the first carrier in the combined carrier of the received combined wave.

Each carrier, which may be divided in frequency, each by the same factor, passes through a zero-crossing detector, which generates short pulses at each zero crossing, at a rate of more than twice the highest program frequency in herz. Each such pulse opens a gate which samples, in each channel, the combined signal, producing from the first gate a first sequence of short samples of the first signal, synchronously demodulated, and from the second gate a second sequence of short samples of the second signal, also synchronously demodulated. Each sequence is free from any components of the sequence of samples of the signal of the other channel, because the samples have been taken at instants of zero crossings, that is zero amplitudes of the signal of the other channel. The sequences are separately integrated in filters. In one embodiment of the invention each filter is a low-pass filter and its output is the corresponding program, substantially free from the other program.

A second embodiment of the invention achieves a similar result by sampling the combined signal in each channel at a rate greater than twice the program bandwidth in herz at instants of zero-crossings of the carrier of the other channel, using in each channel a bandpass filter, centered on a multiple of the sampling frequency, with a pass band as great as the signal band, and subsequently demodulating the resultant amplitude-modulated wave.

The operation of the receiver depends on the sampling theorem, which is given in simplified form in Transmission Systems for Communications, New York 1971, pages 116 to 118 and 125 to 128, inclusive. This teaches that if a program which is a magnitude-time function is sampled instantaneously at regular intervals and at a rate at least twice the highest program frequency, then the samples contain all of the information of the original program. To reconstruct the program at the receiving apparatus it is necessary to pass this regularly-spaced series of samples through a low-pass filter with a cut-off frequency above the highest program frequency. Except for an overall time-delay and a constant of proportionality, the output of the filter will then be identical to the original program. It is then possible to reproduce a program exactly, given the instantaneous amplitudes of the program at a rate of twice the highest program frequency. This is a simplified exposition, but applies to this invention, since the samples of the envelopes of the modulated waves, which are identical with the programs, are required to be delivered to the low-pass filters. For the full theory of sampling, reference is made to Reference Data for Radio Engineers, New York 1970, page 21–14 and the reference quoted therein.

DETAILED DESCRIPTION OF THE INVENTION

Figure 1:
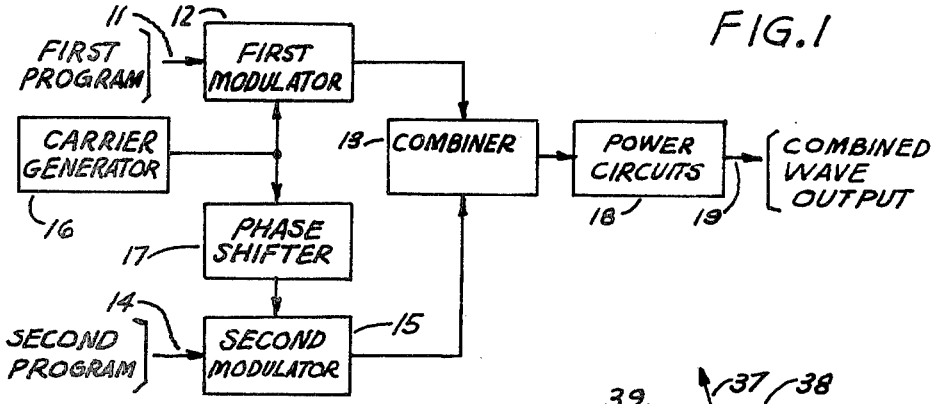
FIG. 1 shows a block schematic of transmitting apparatus suitable for this system.

FIG. 1 shows transmitting apparatus which is suitable for this system. A first program on lead 11 is delivered to modulator 12 and the resultant amplitude-modulated wave is delivered to a first input of linear combiner 13, which may consist of a transformer with two input windings and one output winding. The second program on lead 14 is delivered to second modulator 15 and the resultant amplitude-modulated wave is delivered to a second input of combiner 13. Carrier generator 16 generates a constant-amplitude constant-frequency carrier which is delivered directly to first modulator 12 and through phase shifter 17, with phase shift of less than 90°, to second modulator 15.

Poling of the programs, carrier generator 16, phase shifter 17, modulators 12 and 15, combiner 13, and their interconnections, is such that when the carriers and programs are identical and the phase shifter has zero phase shift, the combiner output is the sum of two identical modulated waves. The output of combiner 13 passes through power circuits 18, which may include usual transmitter circuits such as linear amplifiers, tuned and coupled circuits, modulation limiters and others, to combined wave output lead 19. Attenuation may be added to the paths from generator 16 to modulator 12 and phase shifter 17.

Figure 2:
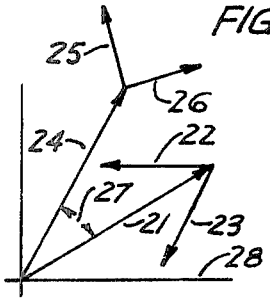
FIG. 2 shows a phasor diagram of the two modulated waves before combination in transmitting apparatus suitable for this system.

FIG. 2 shows a phasor diagram of the two modulated waves of FIG. 1, from modulators 12 and 15, assuming single-frequency programs on leads 11 and 14, equal carriers, and a phase shift of 30° in phase shifter 17. The first carrier delivered to modulator 12, vector 24, rotates in a counterclockwise direction and its projection on baseline 28 represents its instantaneous amplitude. Modulator 12 produces an upper sideband 26 rotating counterclockwise and a lower sideband 25 rotating in a clockwise direction, an assumption which maintains generality. Similarly the second carrier is phasor 21, rotating counterclockwise at the same angular velocity as phasor 24, but remaining behind phasor 24 by a constant angle 27, which is the phase shift of phase shifter 17, and carrier 21 has upper sideband 22 and lower sideband 23.

Figure 3:
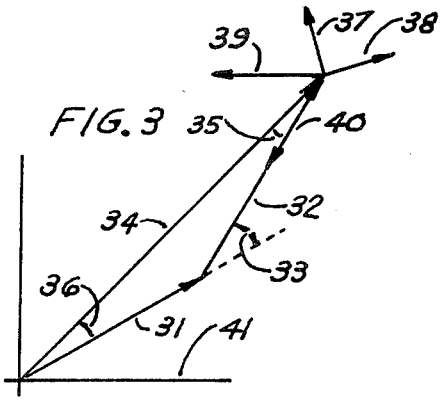
FIG. 3 shows a phasor diagram of the two carriers after combination in transmitting apparatus suitable for this system.

FIG. 3 is a phasor diagram of the combined wave. First carrier 32 adds to second carrier 31 at an angle 33 which is the angle of phase shifter 17, giving the combined carrier 34. Sidebands 37 and 38 of first carrier 32, and sidebands 39 and 40 of second carrier 31 are shown at their correct angular positions relative to their carriers, taken from FIG. 2. It is seen in FIG. 3 that the sidebands are displaced from correct angular positions relative to combined carrier 34, by one-half the angle of shift of the phase shifter. This may cause angle modulation of combined carrier 34.

The baseline for projection of phasors of FIG. 3 is designated 4. If however the two programs are identical, or nearly so, as in stereo transmission, it is obvious that the angle modulation from one program substantially cancels the angle modulation from the other program, as can be observed from FIG. 3.

Figure 4:
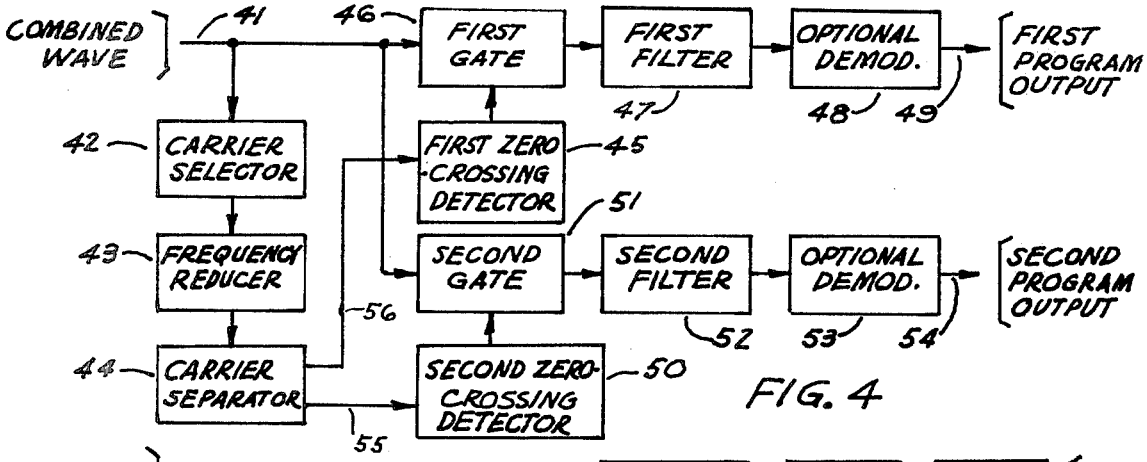
FIG. 4 shows a block schematic of an embodiment of the invention in a receiving apparatus.

FIG. 4 shows a block schematic of an embodiment of the invention in a receiving apparatus. A combined wave is delivered on lead 41. This wave may be the wave as generated by transmitting apparatus as shown in FIG. 1, or the wave from FIG. 1 may be amplified and shifted in frequency after transmission over a cable, radio, optical or other path, or be otherwise modified, retaining however its identity as a combined wave consisting of two carriers amplitude-modulated and with a phase difference less than 90°, carrying the two programs.

The input combined wave passes through carrier selector 42, which filters and limits the wave to remove all noise and modulation from the combined carrier and delivers the carrier to frequency reduction means 43. Such carrier selector devices are well-known in the prior art, for example U.S. Pat. Nos. 3,430,151 granted Feb. 25, 1969 to Badessa, 2,194,292 granted Mar. 19, 1940 to N. R. Bligh et al, 3,628,155 granted Dec. 14, 1971 to Muzzi, and 3,311,833 granted Mar. 28, 1967 to Lewis et al.

The carrier is then delivered to frequency-reduction means 43, which generates a new carrier wave having a frequency equal to the input carrier frequency, divided by a number equal to unity or greater. Such a device is well known to the prior art. The output frequency of frequency reduction means 43 is at least as great as the highest modulating program frequency of the combined wave at lead 41, and may be a frequency as high as the combined carrier frequency.

The output of frequency reduction means 43 is delivered to a carrier separator, which is a network with two outputs, 55 and 56. Output 55 transmits a carrier having zero crossings at instants of zero crossings of the first carrier in the combined carrier of the combined wave at lead 41. Output 56 transmits a carrier having zero crossings at instants of zero crossings of the second carrier in the combined carrier of the combined wave at lead 41.

Figure 5:
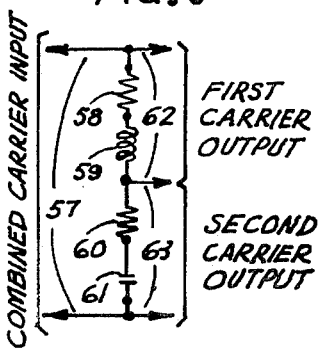
FIG. 5 shows one type of network for resolving the combined carrier into the two signal carriers.

A sample network which performs the function of carrier separator 44 in FIG. 4 is shown in FIG. 5. The reduced combined carrier input is applied across leads 57, and one separated carrier appears on leads across resistor 58 and inductor 59 in series, the other separated carrier appearing on leads 63 across resistor 60 and capacitor 61 in series. It is obvious that by simple computation of the elements of the network, the carrier across leads 62 can be caused to have the desired relationship in phase and amplitude to the carrier across leads 63 and to the received combined carrier.

In FIG. 4 lead 56 transmits carrier to a first channel commencing with first zero-crossing detector 45. This is a device well known in the prior art, which generates a short pulse each instant that the input passes through zero. One such detailed circuit is given by Prigozy in Electronics, Apr. 19, 1965 on p. 91, also by Weiss in Electronics 34:24, p. 52.

A zero-crossing detector is also shown in U.S. Pat. No. 3,430,151, granted Feb. 25, 1969 to Badessa, as item 14 of his FIG. 1. Each pulse from zero-crossing detector 45 opens first gate 46 and allows a short sample of the combined wave to pass. This sample forms one of a sequence which contains no components of the second signal, since it is taken at zero crossings of the second signal, but consists only of a sequence of short samples of the first signal, at a rate of at least twice the highest program frequency and hence twice the highest frequency of the envelope of the first signal. This sequence of samples fully defines the first signal, by sampling theory. The sequence passes into and is integrated in first filter 47. When filter 47 is a low-pass filter with a cut-off frequency above the highest program frequency but below the sampling frequency, then by the sampling theorem the output of filter 47 is a replica of the first program, and is passed directly to output lead 49. If first filter 47 is a band-pass filter with a pass-band greater than but less than twice the signal band and centered on a multiple of the sampling frequency, then by the sampling theory and as shown in Transmission Systems for Communications, New York 1971, in FIG. 6-4 on page 128, the output of filter 47 is a double-sideband amplitude-modulated signal, with an envelope with the same waveform as the first program. This signal may be passed through optional demodulator 48, which then delivers a replica of the first program to output lead 49. When demodulation is not desired, the amplitude-modulated wave at the output of filter 47 may be delivered directly to output lead 49.

An exactly similar path exists as a channel for the second signal. Lead 55 delivers the first carrier to second zero-crossing detector 50, which delivers short pulses at instants of carrier zero crossings to second gate 51, which passes short samples of the combined wave on lead 41, consisting of components of only the second signal, since the samples have been taken at instants of zero crossings of the first signal, to second filter 52, which may also be a band-pass filter, like filter 47 described above, in some cases through optional demodulator 53, and then to second program output 54.

Figure 6:
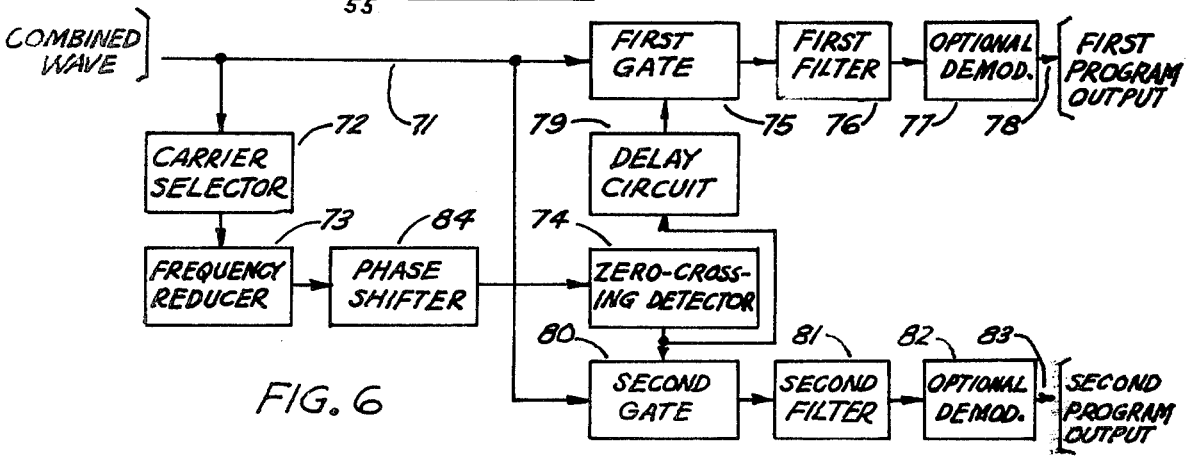
FIG. 6 shows a block schematic of another arrangement of receiving apparatus embodying the invention.

FIG. 6 shows another embodiment of the invention in a receiving apparatus. A combined wave, of the type generated in FIG. 1, which may be modified by amplification, frequency shifting or otherwise, while retaining the character of the combined wave, is received on lead 71, the carrier is selected and reduced in frequency by circuits 72 and 73, as in the corresponding circuits of FIG. 4, and passed through phase shifter 84, which shifts the reduced combined carrier to have zero crossings at instants of zero crossings of the first carrier in the combined carrier of the combined wave at lead 71.

The output of phase shifter 84 goes to zero-crossing detector 74, where a short pulse is generated at each zero crossing of the carrier, as described above. These pulses open second gate 80, permitting short samples of the combined wave, free from the components of the first signal, to pass to second filter 81, optional demodulator 82 and second program output 83, as in the corresponding path of FIG. 4. Pulses from zero-crossing detector 74 are also led to delay circuit 79, where they are delayed by a period of time equal to the time delay between the first and second carriers of the combined wave plus zero or an integral number of carrier half-periods. One circuit for achieving such delay is shown by Ferrara, "Delayed Pulse Generator", EEE, 13:10, page 71. The sequence of delayed pulses opens first gate 75 for short periods to generate a sequence of samples of the combined wave less any components of the second signal. This sequence is integrated in first filter 76, passes through optional demodulator 77 if used, and appears on first program output lead 78, as already described for the similar path of the first channel in FIG. 4.

We have described in this specification means and method of generating and combining two amplitude-modulated signals derived from different programs on a single carrier at a transmitting apparatus, and means and method for separating the two signals at a receiving apparatus with two different circuits disclosed. The description of the invention, and of the manner and method of making and using it, has been given in such full, clear, concise and exact terms as to enable any person skilled in the art of transmitting and receiving apparatus, and in sampling and modulation theory, to make and use the invention. We consider the best mode for carrying out our invention to be that described and shown in FIG. 4.

We claim:

1. A system comprising transmitting and receiving apparatus, for transmission of two different programs by double-sideband amplitude modulation of two different carriers of the same frequency, and phase difference less than 90°, and reception and substantially complete separation of said programs, by sampling the combined wave separately at instants of zero crossings of each of said modulated carriers and by integrating the sample sequences so produced.

2. Receiving apparatus which receives a combined wave comprising a first carrier double-sideband amplitude modulated by a first program, and a second carrier double-sideband amplitude modulated by a second program, said carriers having the same frequency and being displaced in phase from each other by less than 90°, and which delivers a first output wave comprising said first program or a carrier amplitude modulated by said first program, substantially free from components derived from said second program, and which delivers a second output wave comprising said program, or a carrier amplitude-modulated by said second program, substantially free from components of said first program, by sampling said combined wave in a first sampling gate at instants of zero crossings of said second carrier at a rate greater than the bandwidth of said first modulated carrier, and integrating the output of said first sampling gate in a filter, and by sampling the combined wave in a second sampling gate at instants of zero crossings of said first carrier at a rate greater than the bandwidth of said second modulated carrier, and by integrating the output of said second sampling gate in a filter.

3. Receiving apparatus according to claim 2 which comprises:

a source of said combined wave which is delivered to carrier selection means, to a first gating means and to a second gating means, and carrier selection means which comprises selective and limiting means, which eliminates substantially all modulation and noise from the carrier of said combined wave and delivers said combined carrier, and frequency reduction means, which receives said combined carrier from said carrier selection means and reduces said combined carrier frequency by a number equal to unity or greater, so that the output of said frequency reduction means has a frequency at least twice as great as the highest frequency of said first and second programs, and carrier separation means which receives said output of said frequency reduction means, and delivers at a first output a first reduced carrier having zero crossings at instants of zero crossings of said first carrier in said combined carrier at said source of combined waves, and delivers at a second output a second reduced carrier having zero crossings at instants of zero crossings of said second carrier in said combined carrier at said source of combined waves, and first zero-crossing detection means which receives said second reduced carrier from said second output of of said separation means and produces a first sequence of short gating pulses at zero crossings of said second reduced carrier, and said first gating means which receives said combined wave and said first sequence of short gating pulses, and passes a first sequence of short samples of said combined wave at instants of zero crossings of said second reduced carrier, and first filter means, which receives and integrates said first sequence of samples, which is a low-pass filter with a cut-off frequency equal the highest frequency of said first program, and which delivers a replica of said first program substantially free from components of said second program to a first program output circuit, and second zero-crossing detection means, which receives said first reduced carrier from said first output of said separation means and produces a second sequence of short gating pulses at zero crossings of said first reduced carrier, and said second gating means, which receives said combined wave and said second sequence of short gating pulses, and passes a second sequence of short samples of said combined wave at instants of zero crossings of said first reduced carrier, and second filter means, which receives and integrates said second sequence of samples, which is a low-pass filter with a cut-off frequency equal to the highest frequency of said second program, and which delivers a replica of said second program substantially free from components of said first program to a second program output circuit.

4. Receiving apparatus according to claim 2 which comprises:

a source of said combined wave which is delivered to carrier selection means, to a first gating means and to a second gating means, and carrier selection means which comprises selective and limiting means, which eliminates substantially all modulation and noise from the carrier of said combined wave and delivers said combined carrier, and frequency reduction means, which receives said combined carrier from said carrier selection means and reduces said combined carrier frequency by a number of equal to unity or greater, so that the output of said frequency reduction means has a frequency at least twice as great as the highest frequency of said first and second programs, and carrier separation means which receives said output of said frequency reduction means, and delivers at a first output first reduced carrier having zero crossings at instants of zero crossings of said first carrier in said combined carrier at said source of combined waves, and delivers at a second output a second reduced carrier having zero crossings at instants of zero crossings of said second carrier in said combined carrier at said source of combined waves, and first zero-crossing detection means which receives second reduced carrier from said second output of said separation means and produces a first sequence of short gating pulses at zero crossings of said second reduced carrier, and said first gating means which receives said combined wave and said first sequence of short gating pulses, and passes a first sequence of short samples of said combined wave at instants of zero crossings of said second reduced carrier, and first filter means, which receives and integrates said first sequence of samples, which is a band-pass filter with a pass band equal to the bandwidth of said combined wave, centered on an integral multiple greater than unity of the frequency of said first sequence of short pulses, and which delivers a double-sideband amplitude modulated wave whose envelope has the waveform of said first program, substantially free from components of said second program to a first program output circuit, and second zero-crossing detection means, which receives said first reduced carrier from said first output of said separation means and produces a second sequence of short gating pulses at zero crossings of said first reduced carrier, and said second gating means, which receives said combined wave and said second sequence of short gating pulses, and passes a second sequence of short samples of said combined wave at instants of zero crossings of said first reduced carrier, and second filter means, which receives and integrates said second sequence of samples, which is a band-pass filter with a pass-band equal to the bandwidth of said combined wave, centered on an integral multiple greater than unity of the frequency of said first sequence of short pulses, and which delivers a double-sideband amplitude modulated wave whose envelope has the waveform of said second program, substantially free from components of said first program to a second program output circuit.

5. Receiving apparatus according to claim 2 which comprises:

a source of a combined wave which is delivered to carrier selection means, to a first gating means and to a second gating means, and carrier selection means which comprises selective and limiting means, which eliminates substantially all modulation and noise from the carrier of said combined wave and delivers said combined carrier, and frequency reduction means which receives said combined carrier from said selection means and reduces said combined carrier frequency by a number equal to or greater than unity, so that the output of said frequency reduction means has a frequency of zero crossings equal to the frequency of zero crossings of said combined carrier, divided by a number equal to or greater than unity, and has a frequency at least twice as great as the highest frequency of said first and second programs, and phase shifting means which shifts the phase of the output of said frequency division means so that zero crossings of the reduced carrier at the output of said phase shifting means occur at instants of zero crossings of said first carrier in said combined carrier, and zero-crossing detection means which receives the output of said phase shifting means and generates a first sequence of short gating pulses at instants of zero crossings of said output of said phase shifting means, and second gating means which receives said combined wave and said first sequence of gating pulses and produces a second sequence of short samples of said combined wave at instants of zero crossings of said first carrier in said combined carrier, and second low-pass filter means with a cut-off frequency equal to the highest frequency of said second program which receives and integrates said second sequence of samples, and which delivers said second program substantially free from components of said first program to a second program output circuit, and pulse delay means which receives said first sequence of pulses from said zero-crossing detection means and produces a second sequence of gating pulses delayed from said first sequence of gating pulses by a period equal to the delay between said first and second carriers plus an integral number, including zero, of half periods of said combined carrier, and first gating means which receives said combined wave and said second sequence of gating pulses and produces a first sequence of short samples of said combined wave, at instants of zero crossings of said first carrier in said combined carrier, and first low-pass filter means with a cut-off frequency equal to the highest frequency of said first program which receives and integrates said first sequence of samples, and which delivers said first program substantially free from components of said second program to a first program output circuit.

6. The method of transmitting and receiving two different programs double-sideband amplitude modulated on a single carrier, which comprises:

modulating each program separately on a carrier, the carriers being equal in frequency and spaced less than 90° in phase, and combining the two modulated carriers to form a combined wave, and receiving the combined wave, deriving from it the combined carrier free from modulation and noise, reducing the combined carrier frequency by a number equal to or greater than unity, with a resultant frequency higher than twice the highest program frequency, deriving from the frequency reduced carrier two reduced carriers with zero crossings at instants of zero crossings of the two carriers in the combined wave, respectively, generating two sequences of short gating pulses, the first of said sequences at instants of zero crossings of said first carrier and the second of said sequences at instants of zero crossings of said second carrier in said received combined wave, using said second sequence of gating pulses to drive a first gating means sampling said combined wave, thus producing a first sequence of short samples of said first modulated wave in said combined wave, and integrating said first sequence of samples to produce said first program substantially free from said second program; using said first sequence of gating pulses to drive a said second gating means sampling said combined wave, thus producing a second sequence of short samples of said second modulated wave in said combined wave, and integrating said second sequence of samples to produce said second program substantially free from components of said first program.

* * * * *